United States Patent [19]

Fanget

[11] Patent Number: 4,688,968

[45] Date of Patent: Aug. 25, 1987

[54] CHOCK BLOCK SKIDDING DEVICE DESIGNED FOR THE POWERED SUPPORTS USED IN THE MINES

[76] Inventor: Paul Fanget, Andrezieux Boutheon, Loire, France

[21] Appl. No.: 872,183

[22] Filed: Jun. 9, 1986

[30] Foreign Application Priority Data

Jun. 20, 1985 [FR] France ..... 85 09754

[51] Int. Cl.[4] ..... E21D 23/04

[52] U.S. Cl. ..... 405/296; 405/291

[58] Field of Search ..... 405/296, 295, 291, 292–294, 405/297–301; 299/33; 91/170 MP

[56] References Cited

U.S. PATENT DOCUMENTS 3,915,500 10/1975 Schlusener et al. ..... 405/296 X
4,187,042 2/1980 Plevak et al. ..... 405/291
4,313,698 2/1982 Maykemper et al. ..... 405/296
4,422,807 12/1983 Dettmers et al. ..... 405/296
4,491,441 1/1985 Freeman et al. ..... 405/294
4,518,284 5/1985 Becker et al. ..... 405/296

FOREIGN PATENT DOCUMENTS 3401009 1/1985 Fed. Rep. of Germany ..... 405/296

*Primary Examiner*—Dennis L. Taylor

[57] ABSTRACT

A device designed to skid the chock blocks of a powered support of the type used in coal mines. The front of the skid cylinder is connected with a skid bar whose front end is jointed on an armored conveyor. The rear end of the cylinder is jointed on the rear end of an arm whose front end is jointed on the chock block pads.

22 Claims, 14 Drawing Figures

CHOCK BLOCK SKIDDING DEVICE DESIGNED FOR THE POWERED SUPPORTS USED IN THE MINES

BACKGROUND OF THE INVENTION

The present invention pertains to a new type of skid device designed to equip powered support chock blocks of the same type as those that are used in mines. In particular, the support of the present invention is used for coal shortwall mining.

Usually, an armored coal conveyor is placed along the working face of the mine. The support chock blocks are respectivly perpendicular with the direction of the armored conveyor behind which they are aligned next to one another. The pads of each chock block or chock block assembly are connected with the armored conveyor by one or several horizontal skid cylinders. Traditionally, upon completion of mining at a given station, the skid operations are performed as follows.

During the first stage and with the chock blocks pressed against the top, each skid cylinder pushes the respective end of the armored conveyor forward. After the conveyor comes to a stop in its new position, each chock block is released and moved forward under the action of the skid cylinder which is actuated in a direction opposite to that of the first stage.

As soon as each chock block has been skidded to its new position, it is pressed against the top and the site is ready to be used as a new mining station.

Generally, during all of these operations, the back of the chock block, which constitutes a driving shield, remains exposed to possible rock falls from old workings.

During operation, traditional skid devices offer two types of disadvantages. First, the skid device defines an excessive length at the back of the chock block, particularly when the latter is very close to the armored conveyor and this disadvantage is particularly noticeable in the case of short chock blocks. Second, the back of the skid device, and particularly its relatively fragile hydraulic components, is exposed, behind the chock block, to possible rock falls from old workings.

The present invention eliminates these disadvantages by offering a skid device whose hydraulic components are protected at all times and wherein the length is significantly reduced, particularly in the direction of the old workings.

SUMMARY OF THE INVENTION

A skid device according to the present invention includes at least one horizontal hydraulic cylinder which connects the bridge of an armored conveyor with both pads of a chock block between which it is located. The device is characterized by the fact that the front end of the cylinder is connected with at least one guiding slide-bar jointed in front onto the bridge of the armored conveyor, whereas the rear end of the cylinder is supported, between both pads, by the rear end of an arm which is jointed in front onto the chock block pads.

Thus, the hydraulic cylinder never extends beyond the rear portion of the two pads between which it is located. Furthermore, the extension of the cylinder causes the armored conveyor to advance and its skid to rest directly on the chock block which is pressed against the top, whereas the retraction of the skid cylinder causes the released chock block to advance, while resting on the armored conveyor stopped by the skid device of the adjoining chock blocks.

The attached schematic drawings will give a better understanding of the specifications of the invention.

DETAILED DESCRIPTION OF THE PREFERRED EMBODIMENT

Figure 1:
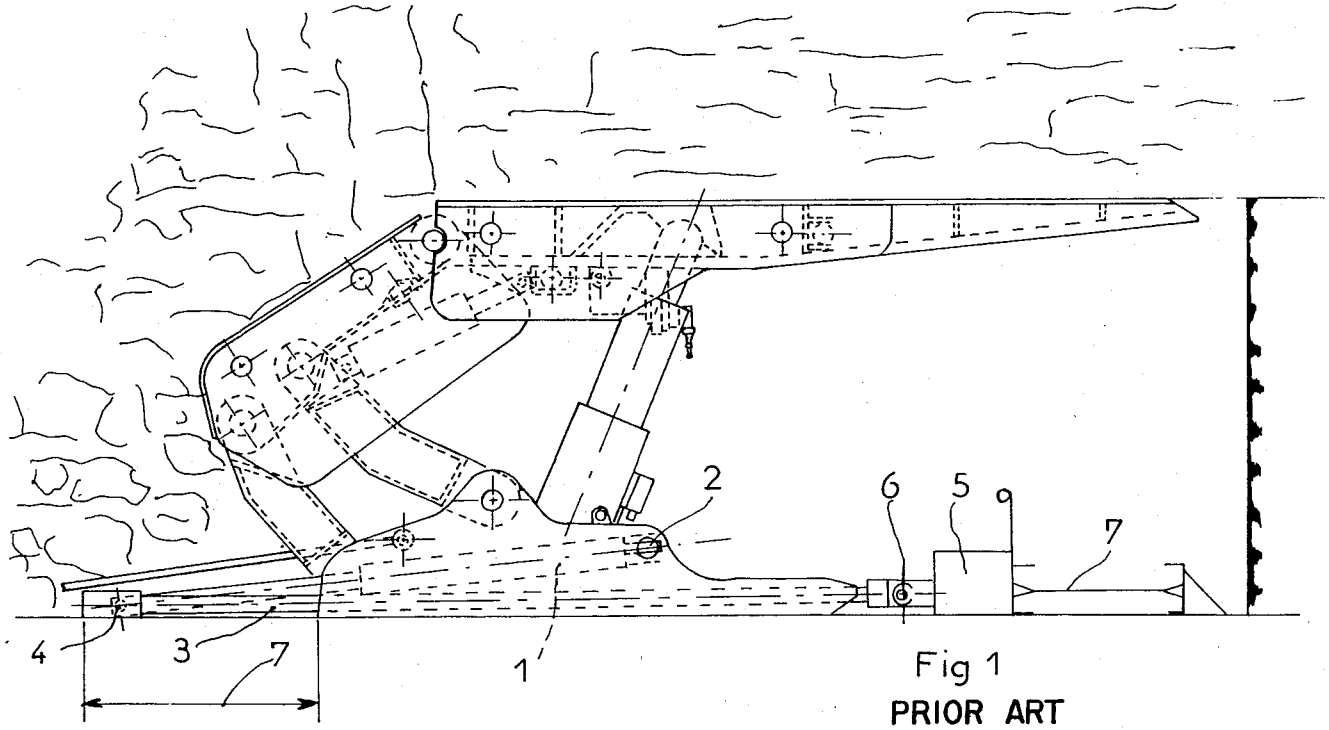
Fig 1 PRIOR ART
FIG. 1 is a schematic side view of the traditional skid device whose disadvantages are thus highlighted.

A prior art skid device as illustrated in FIG. 1, includes a cylinder 1 which is both connected with the chock block pads through the cross-bar 2 and with bars 3 by a pin 4. The bars 3 are connected in front with the bridge of an armored conveyor 5 by a pin 6. The complete extension of the cylinder 1 substantially extends the rear end 7 of the skid device, especially for short chock blocks, and creates a bridge in the immediate vicinity of the chock block.

The purpose of the invention is to partially or entirely eliminate the excess length behind the chock block, so that the skid device and its cylinder 1 in particular, are not fully exposed to rock falls from old workings.

Figure 2:
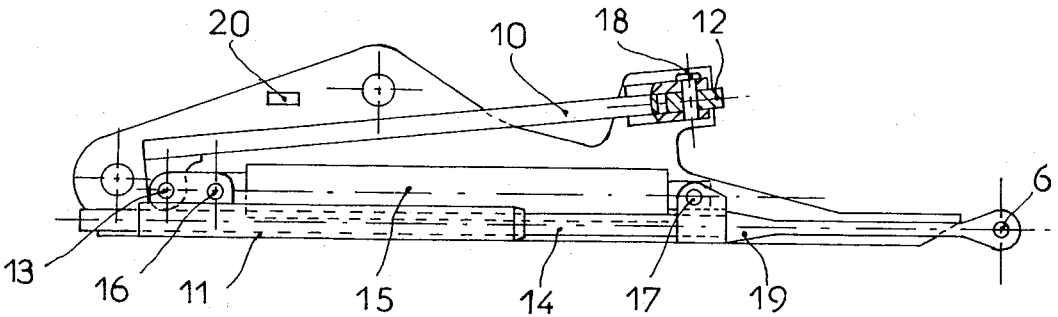
FIGS. 2 and 3 are views similar to FIG. 1 illustrating the skid device of the present invention with the cylinder in retracted and in extended positions, respectively.
Figure 4:
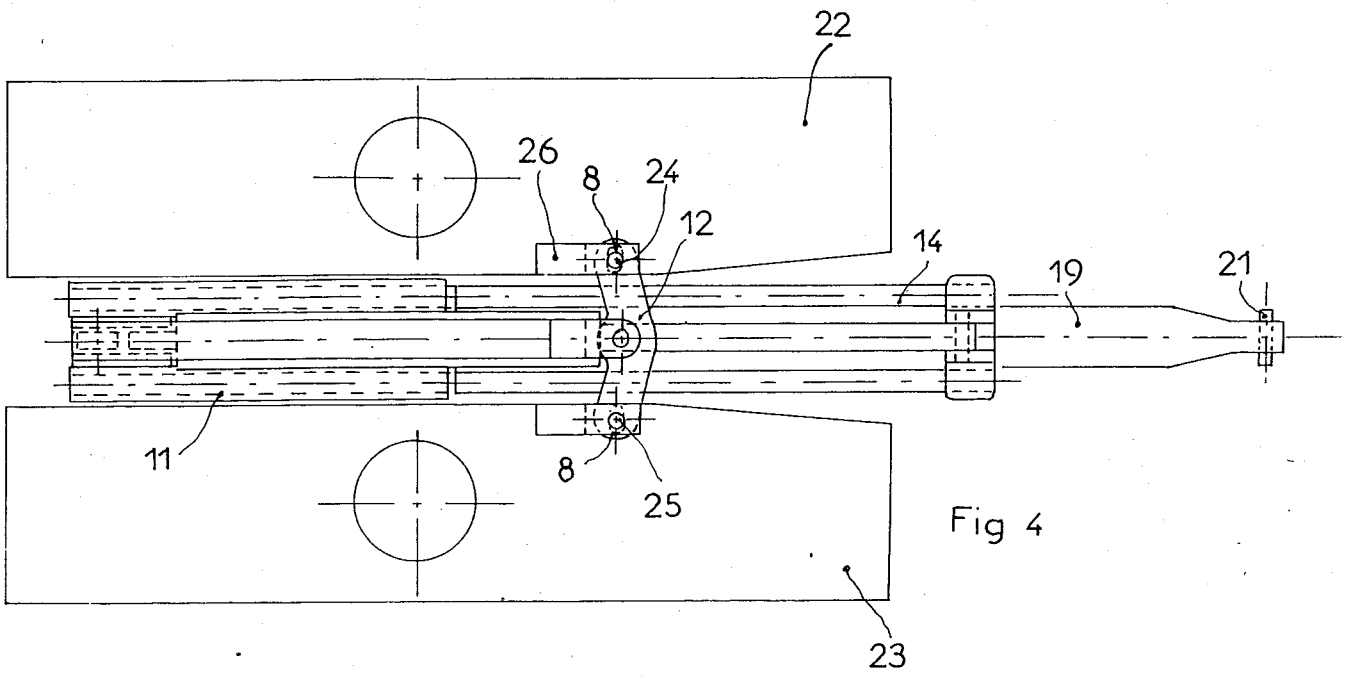
FIG. 4 is a plan view of the skid device of FIGS. 2 and 3 showing the grappling beam used in front of the arm to obtain the jointing on both pads of the chock block.

According to the invention, the device illustrated in FIG. 2 includes an arm 10 which is attached to both a cross-bar 12 connecting two pads 22 and 23 of a chock block (as shown in FIG. 4), and to a bar guide 11 by means of a pin 13. A skid cylinder 15, mounted by pins 16 and 17 or any similar mounting device, is located between the bar guide 11 and an end piece 19 mounted on bars 14. The skid cylinder 15 actuates the skid device.

The operation may be described as follows.

Figure 3:
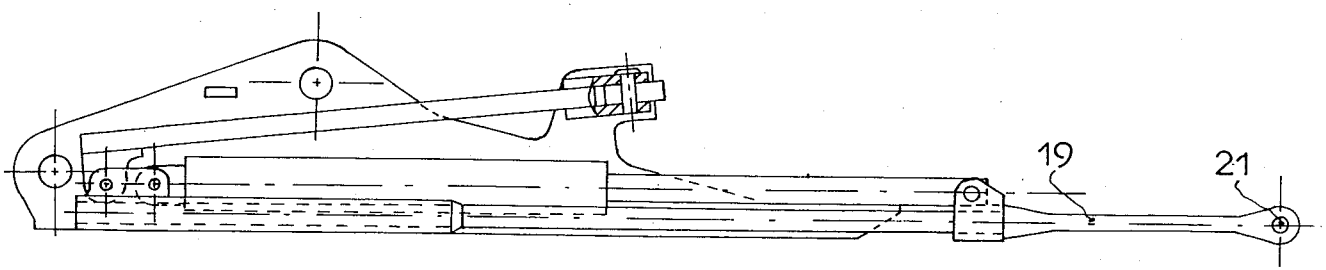

On the face, the armored conveyor 5 skids upon extension of the skid cylinder 15, as illustrated in FIG. 2. The armored conveyor's position, after skidding, is illustrated in FIG. 3.

Figure 5:
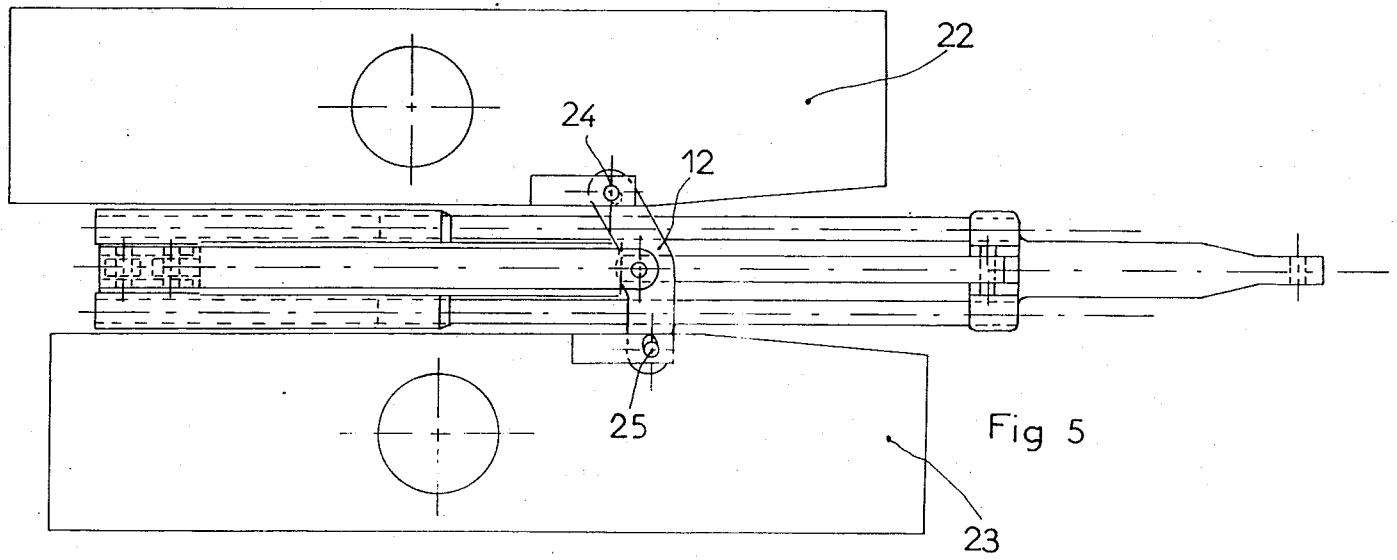
FIG. 5 is a plan view similar to FIG. 4 showing the possible displacement of one of the chock block pads with reference to the other while skidding.
Figure 6:
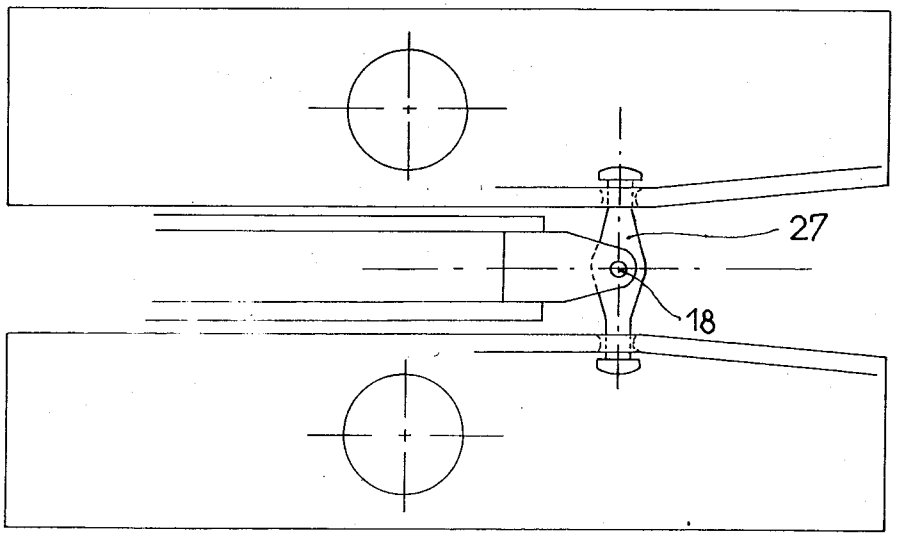
FIG. 6 illustrates an alternate embodiment of the device of the present invention.

FIG. 4 illustrates both pads 22 and 23 of the chock block, interconnected by the cross-bar 12 which has significant freedom of motion at its joints 24 and 25. The joints 24 and 25 may be provided in several ways: by means of a cross-pin including a significant mounting clearance in its holes 8; by means of elongated holes 8 provided in the cross-bar 12 or in a bracket 26 of the pad; or by an opening provided directly in the side of the pads 22 and 23 wherein a cross-bar 27 can be locked while retaining a sufficient play as shown in FIG. 6. FIG. 5 illustrates the motion of one pad with reference to the other in the horizontal plane. This freedom of motion allows the cross-bar 12 or 27 to be mounted on the pads 22 and 23 and also allows the vertical displacement of the pads.

The force applied by the skid cylinder 15, illustrated in FIG. 2, is transmitted to the bar guide 11 by the pin 16 and relayed through the arm 10 which is connected to the bar guide 11 by the pin 13.

This force is then retransmitted by a pin 18 to the cross-bar 12 which, in turn, divides the force into two others which are applied to the pads 22 and 23 through the joints 24 and 25, as shown in FIG. 4.

The cross-bar 12, mounted between the pads 22 and 23, as illustrated in FIG. 5, is designed to transmit the skidding effort by allowing the corresponding displacement of both pads in all planes. The skid device connection with the pads 22 and 23 solely consists of the cross-bar 12, FIG. 5, which permits a significant freedom of motion of the skid assembly with reference to the pads. At the same time, this allows the chock block or the armored conveyor to move in the proper direction as guided by the bars 14 in the bar guide 11, as illustrated in FIG. 4. The end piece 19, which extends from the bars 14, is connected in front with the armored conveyor by a pin 21 and is designed with a flat profile so as to ease the passage of personnel working in the mine. The length of the end piece 19 may vary, depending on the type of chock block used.

The upward motion of the skid assembly is limited by a stop piece 20, as shown in FIG. 2, built into the pads 22 and 23.

Figure 8:
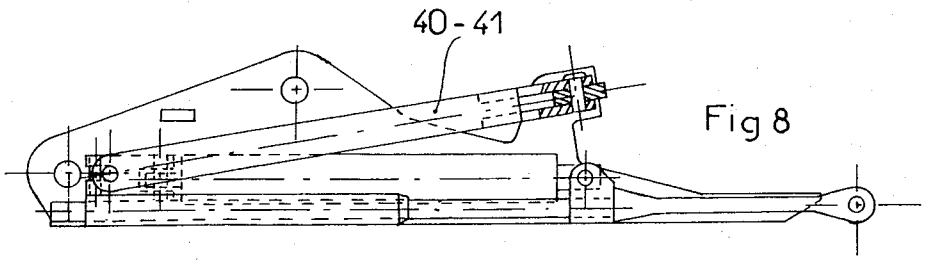
FIGS. 7 and 8 are, respectively, a plan view and a front view illustrating another alternate embodiment of the arm of the present invention.
Figure 7:
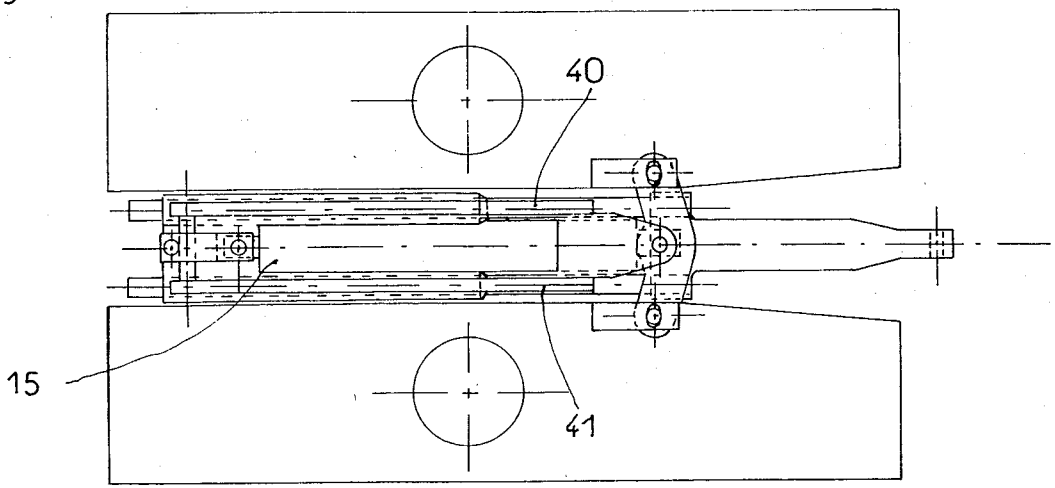

As illustrated in FIGS. 7 and 8, the retainer arm 10 of FIG. 2 may include two flat bars 40 and 41, so that the skid cylinder 15 may pass between these flat bars and, thus, minimize the overall height of the assembly.

Figure 9:
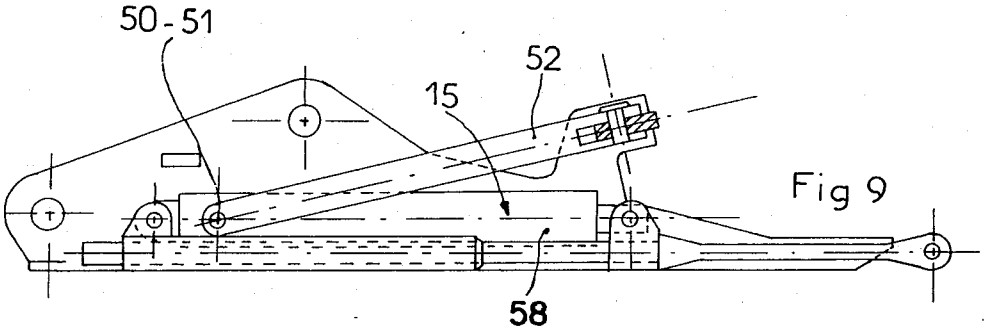
FIG. 9 illustrates a alternative embodiment of the present invention wherein the rear end of the arm is directly attached to the barrel of the skid cylinder.

FIG. 9 illustrates an arm 52 which is directly attached to a barrel 58 of the skid cylinder 15 by pins 50 and 51 located on either side thereof.

Figure 10:
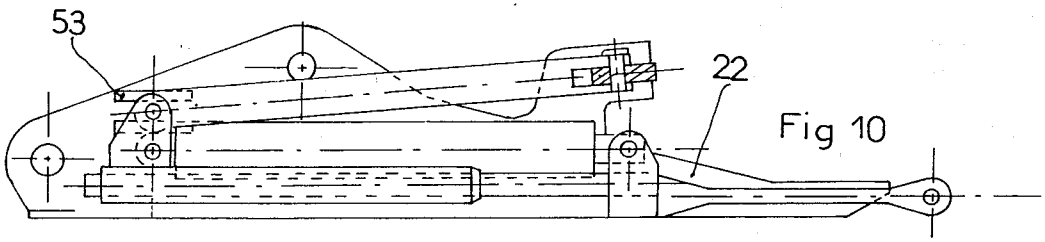
FIG. 10 illustrates another alternative embodiment of the present invention wherein the skid device is guided in the back between both pads.

FIG. 10 illustrates the skid device horizontally guided in the back by a groove 53 provided in the pad 22, with the pad remaining free to move in all planes.

Figure 11:
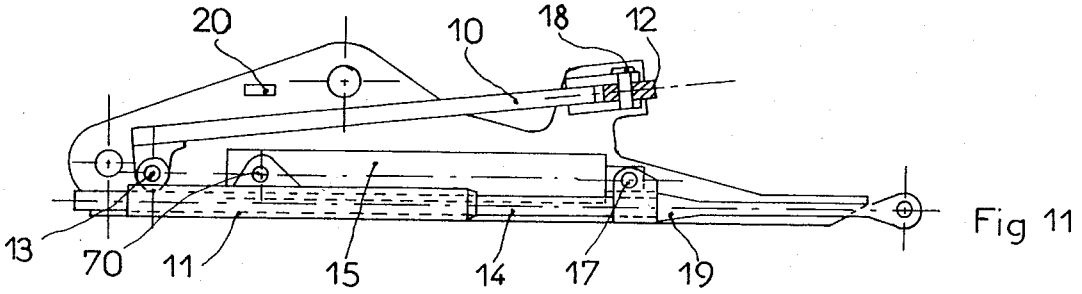
FIG. 11 illustrates an alternate embodiment of the device of FIG. 2 wherein the rear end of the skid cylinder is directly jointed onto a sliding guide.

FIG. 11 illustrates an alternate embodiment of the device of FIG. 2. In this case, the skid cylinder 15 is attached to the bar guide 11 by pins 70, located on either side of the cylinder barrel.

Figure 14:
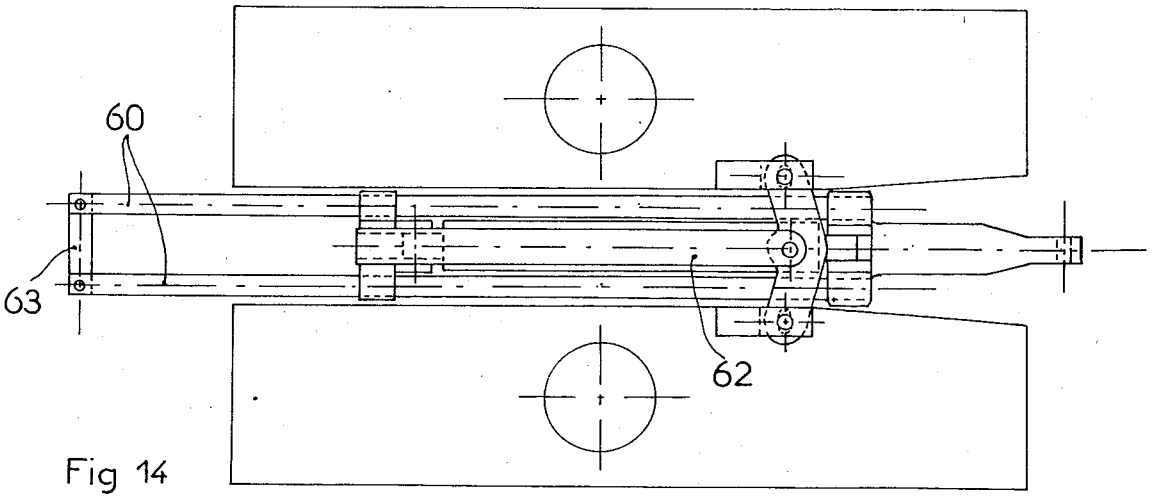
FIGS. 14 illustrates another alternative embodiment of the present invention wherein the guiding bars are interconnected by a rear reinforcement cross-bar.
Figure 13:
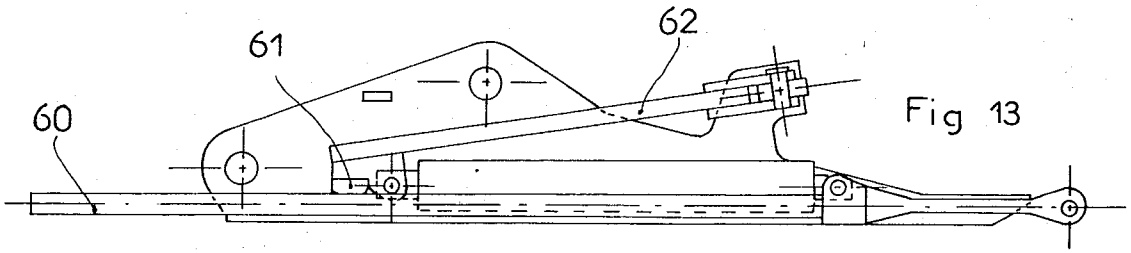
FIGS. 12 and 13 illustrate another alternative embodiment of the guiding bars.
Figure 12:
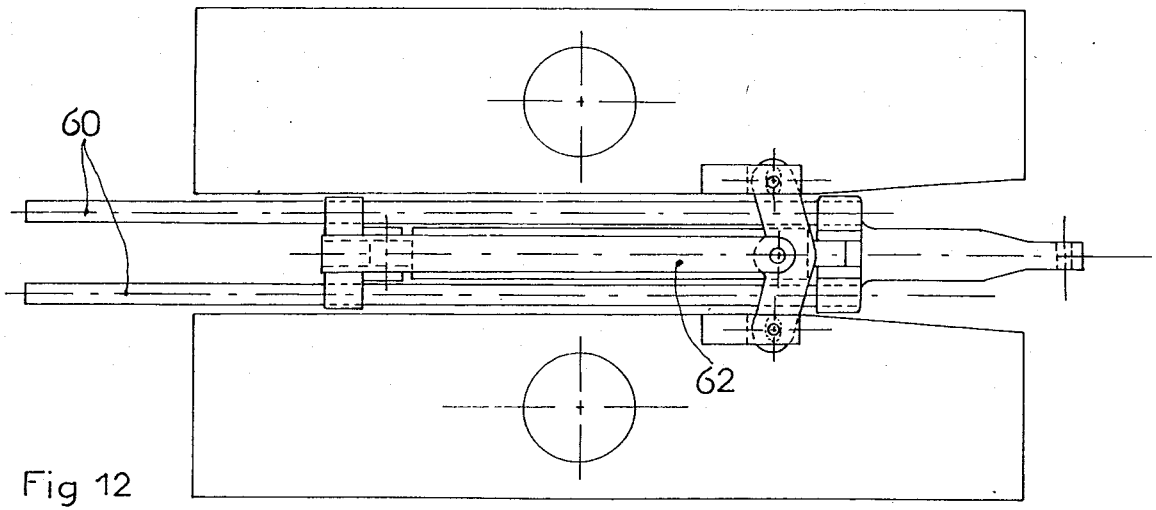

FIGS. 12 and 13 illustrate a device wherein guide bars 60 are not retained by a guide, which requires a greater length for the bars and results in a significant oversize in the back. This disadvantage is alleviated by the fact that the skid bars are the only members exposed to the rock falls from old workings. As illustrated in FIG. 13, an arm 62 rests against the guide bars 60 and a pad 61. In order to reinforce the bar assembly, a rear cross-bar 63, FIG. 14, may be included.

The skid device may be adapted for use with single block pads. The rear cross-bar 63, FIG. 14, no longer has to provide the displacements of one pad with respect to the other and it solely transmits the efforts. Furthermore, the joints or connections 24 and 25 do not require as much operating free play as they would in the case of separate pads.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. Skid device designed for the chock block of a mining powered support and including at least one horizontal hydraulic cylinder which connects the bridge of an armored conveyor with both pads of a chock block between which it is located, wherein the front end of the cylinder is connected with at least one guiding slide bar whose front end is jointed onto the bridge of an armored conveyor, whereas the rear end of the cylinder rests between both pads on the rear end of an arm whose front end is jointed onto the pads of the chock block.

2. Skid device as described in claim 1, wherein the arm is attached both to a front cross-bar which connects both pads of the chock block and to a guide by means of a pin provided on said guide.

3. Skid device as described in claim 2, wherein the cross-bar enjoys a significant freedom of motion in the area of its joints, said joints being constructed in such a manner as to include a cross-pin with a significant free play in its holes, a set of elongated holes provided in the cross-bar or in the pad bracket, an opening directly provided in the side of the pads wherein a cross-piece is locked while retaining a sufficient free play.

4. Skid device as described in claim 1, wherein the end piece which extends the bars is connected in front with the armored conveyor by means of a pin and includes a flat profile so as to easy personnel access to the face.

5. Skid device as described in claim 1, wherein the retainer arm is comprised of two flat bars, the skid cylinder being located between these bars thus minimizing the overall height of this device.

6. Skid device as described in claim 1, wherein the arm is directly jointed onto the barrel of the skid cylinder by means of trunnions located on either side thereof.

7. Skid device as described in claim 1, wherein the rear horizontal guide consists of a groove provided in one of the pads, said pad retaining their freedom of relative motion in every plane.

8. Skid device as described in claim 2, wherein the cylinder is attached to the guide by means of trunnions located on either side of the barrel of the cylinder.

9. Skid device as described in claim 2, wherein the guide bars are not retained in a guide, whereas the arm rests on these bars through a pad.

10. Skid device as described in claim 9, wherein the rear end of the guide bars is connected by a reinforcing cross-piece.

11. A powered mining support comprising:

a chock block, said chock block having a pair of spaced-apart pads;

a generally horizontally extending fluid-powered cylinder, said fluid-powered cylinder being disposed between said pair of spaced-apart pads and having a front end and a rear end;

at least one guiding slide bar, said front end of said fluid-powered cylinder being connected to said at least one guiding slide bar, said at least one guiding slide bar being adapted to be connected to the bridge of an armored conveyor; and an arm having a rear end and a front end, said rear end of said arm being connected to said rear end of said fluid-powered cylinder, said front end of said arm being pivotally connected to each of said spaced-apart pads of said chock block.

12. A powered mining support according to claim 11 and further comprising:

a cross-bar, said cross-bar being pivotally connected to each of said spaced-apart pads of said chock block at a pair of spaced apart axes, respectively, said arm being pivotally connected to said cross-bar at an axis intermediate said pair of spaced-apart axes.

13. A powered mining support according to claim 12 and further comprising:

a bar guide disposed between said pair of spaced-apart pads of said chock block, said rear end of said arm and said rear end of said fluid-powered cylinder each being connected to said bar guide, said rear end of said arm being pivotally connected to said bar guide.

14. A powered mining support according to claim 12 wherein said cross-bar comprises first and second joints, said first and second joints, respectively, being connected to said pair of spaced-apart pads of said chock block to permit significant freedom of motion therebetween.

15. A powered mining support according to claim 14 wherein said first and second joints of said cross-bar have first and second holes, respectively, wherein said pair of spaced-apart pads of said chock block are provided with first and second pins, respectively, wherein said first and second pins are received in said first and second holes, respectively, and wherein said first and second holes are substantially larger than said first and second pins, respectively.

16. A powered mining support according to claim 11 and further comprising:

an end piece attached to said at least one guiding slide bar, said end piece having a flat profile to ease the passage of personnel working in the mine, said end piece having a pin by which said end piece, and therey said guiding slide bar, is adapted to be connected to said bridge of said armored conveyor

17. A powered mining support according to claim 12 wherein said cross-bar comprises first and second flat bars, said fluid-powered cylinder extending between said first and second flat bars to thereby minimize the overall height of said powered mining support.

18. A powered mining support according to claim 12 wherein said fluid-powered cylinder has a barrel with a pair of trunnions on opposite sides thereof and wherein said rear of said arm is pivotally connected to said barrel of said fluid-powered cylinder at each of said pair of trunnions.

19. A powered mining support according to claim 11 wherein one of said pair of spaced-apart pads of said chock block is provided with a groove, said groove forming a rear horizontal guide for said powered mining support, each of said pair of spaced-apart pads having freedom of relative motion in every plane.

20. A powered mining support according to claim 13 wherein said fluid-powered cylinder has a barrel with a pair of trunnions on opposite sides thereof and wherein said bar guide is pivotally connected to said barrel of said fluid-powered cylinder at each of said pair of trunnions.

21. A powered mining support according to claim 13 wherein said bar guide comprises first and second spaced-apart bar guide elements and a pad attached to each of said first and second spaced-apart bar guide elements and wherein said rear end of said arm rests on said pad against said first and second spaced-apart bar guide elements.

22. A powered mining support according to claim 21 wherein each of said first and second spaced-apart bar guide elements has a rear end, and further comprising:

a reinforcing cross-piece attached to each of said first and second spaced-apart bar guide elements adjacent the rear end of each of said first and second spaced-apart bar guide elements.

* * * * *

UNITED STATES PATENT AND TRADEMARK OFFICE

CERTIFICATE OF CORRECTION

PATENT NO. : 4,688,968

DATED : August 25, 1987

INVENTOR(S) : Paul Fanget

It is certified that error appears in the above-identified patent and that said Letters Patent is hereby corrected as shown below:

Column 1, line 14, delete "respectivly" and insert ---- respectively ----.

Column 2, line 36, delete "Figs." and insert ---- Fig. ----.

In the Claims

Column 4, line 40, delete "easy" and insert ---- ease ----.

Column 4, line 51, delete "pad" and insert --- pads ----.

Column 6, line 6, after "conveyor" insert a period ---- . ----.

Signed and Sealed this

Third Day of May, 1988

*Attest:*

*Attesting Officer*

DONALD J. QUIGG

*Commissioner of Patents and Trademarks*